United States Patent [19]

Dravnieks

[11] 4,307,774

[45] Dec. 29, 1981

[54] HEAT WHEEL CONSTRUCTION

[76] Inventor: Konstantins Dravnieks, 220 Madero Dr., Thiensville, Wis. 53092

[21] Appl. No.: 208,677

[22] Filed: Nov. 20, 1980

[51] Int. Cl.[3] ..... F28D 19/00

[52] U.S. Cl. ..... 165/8; 29/157.3 R; 29/455 R; 29/526 R; 165/10

[58] Field of Search ..... 165/8, 10; 29/157.3 R, 29/455 R, 526 R

[56] References Cited

U.S. PATENT DOCUMENTS 3,702,156 11/1972 Rohrs et al. ..... 29/157.3 R X
3,996,997 12/1976 Regan et al. ..... 165/8
4,191,241 3/1980 Brennan ..... 29/157.3 R X
4,209,060 6/1980 Wibing et al. ..... 165/8

FOREIGN PATENT DOCUMENTS 1401622 7/1975 United Kingdom ..... 165/8

*Primary Examiner*—Albert W. Davis

[57] ABSTRACT

A heat wheel is made of spirally wound, interleaved, flat and corrugated strips of metal material. A plurality of circumferentially spaced pairs of radial rods extend between the wheel hub and the outer rim of the wheel. The rods of each pair are disposed in a radial plane and, in that plane, are at an angle to each other so as to form rigid triangular truss-type supports in angularly spaced axial planes.

7 Claims, 9 Drawing Figures

Fig. 3
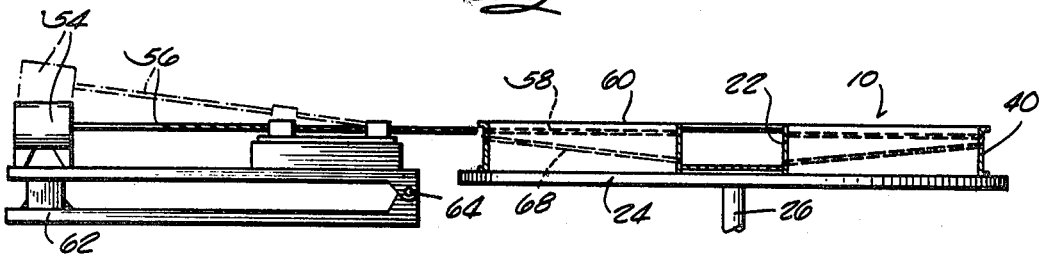
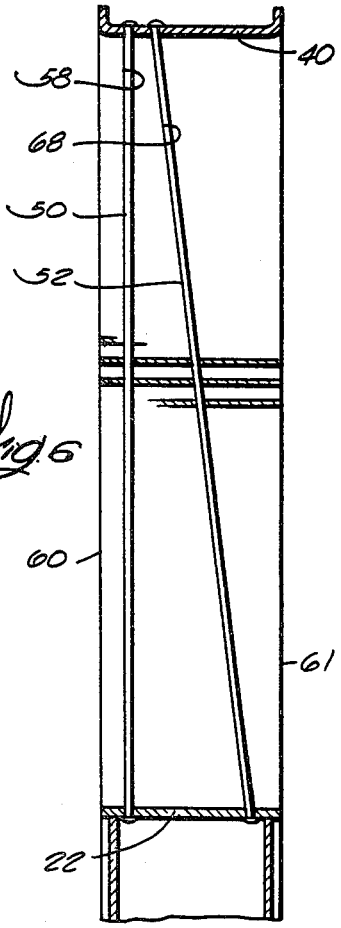
Fig. 6
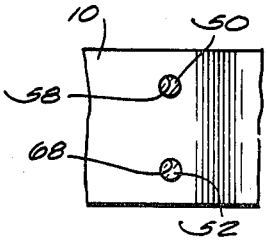
Fig. 7
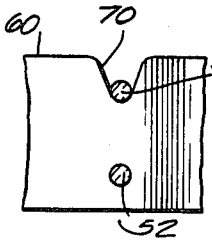
Fig. 8
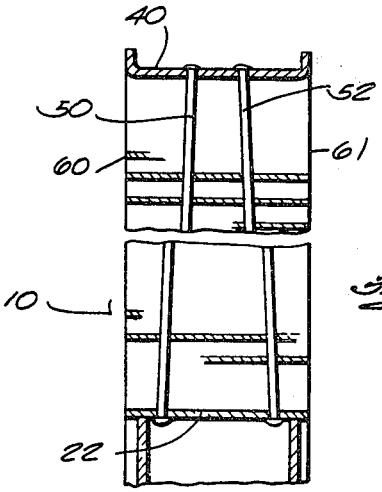
Fig. 9

HEAT WHEEL CONSTRUCTION

FIELD OF THE INVENTION

This invention relates to heat wheels, and, more particularly, to a support arrangement for the medium of a metal heat transfer wheel.

BACKGROUND PRIOR ART

Heat transfer wheels which provide directionally oriented air passages are commonly constructed of spirally wound, interleaved, flat and corrugated metal strips. These strips are wound around a hub and are capped at their outer circumference by a generally cylindrical rim. Such wheels can be relatively large in diameter, for example 12 feet, and are mounted to rotate through hot and cold air passages whereby the interleaved strips can provide a medium for transferring heat from the hot air passages to the cold air passage. This type of heat transfer wheel is a conventional construction and arrangement.

Among the problems encountered with these types of heat transfer wheels is the tendency of the concentric layers of interleaved strips to telescope in an axial direction, and also, when rotating in a vertical plane, the medium has a tendency to alternately compress against the hub and the outer rim during rotation through each 360° turn.

The prior art has addressed these problems and some examples of proposed solutions can be found in U.S. Pat. Nos. 3,702,156, 3,290,764, 2,887,456 and 2,579,912, and French Pat. No. 1,285,255.

SUMMARY OF THE INVENTION

Among the general objects of this invention are to improve the support of spiral wound heat transfer medium of this type and, also, to do so in a manner which better accommodates the temperature variations to which the heat transfer medium is exposed. For the achievement of these and other objects, this invention proposes to counteract the tendency for the strips to telescope and to compress against the hub and rim by extending rods radially through the spirally wound heat transfer medium. A plurality of pairs of rods are arranged around the circumference of the wheel. The rods of each pair are arranged in a common plane extending radially from the axis and including the axis of the wheel, and are arranged at an angle to each other in that plane.

Preferably, the wheel is made up of two continuous metallic strips, one flat, and one corrugated. The strips are spirally wound in interleaved fashion and with the openings defined by each corrugated strip and the adjacent flat strips extending generally parallel to the wheel axis. These openings define air flow passages through the wheel. The strips are wound on a central hub and the outer circumference is closed by a relatively snug-fitting cylindrical rim. The opposite faces of the wheel are generally mutually parallel and are perpendicular to the axis of the wheel. Preferably, each pair of rods has a first rod arranged perpendicular to the wheel axis and spaced inwardly, but adjacent to one face of the wheel. Starting from the outer rim, the second rod extends from a position closely adjacent the end of the first rod along a path diverging from, i.e. at an angle to, the first rod and to a point at the hub closely adjacent the outer face of the wheel. The opposite ends of the rods are welded to the outer rim and to the inner hub. This arrangement of the rods provides a triangular truss-like support which effectively resists any tendency of the concentric layers to telescope in the direction of the axis of the wheel. Also, by virtue of the angle between the rods, the layers are each captured by the rods such that they can not move radially, and the tendency to alternately compress against the outer rim and inner hub is counteracted, i.e. the rods tend to hold the strips in position and against any tendency to move radially against either the rim or the hub.

By positioning a heat transfer wheel in the air duct, the air in the hot air duct downstream of the heat transfer wheel is cooler than the air upstream of the heat transfer wheel. In operation, the heat transfer wheel is positioned such that the face of the wheel closely adjacent the first rod, and to which the rod is substantially parallel, faces the cold or downstream portion of the air duct and the opposite side of the wheel faces the hot air portion of the duct. The significance of this is that the hot air in the duct will cause expansion and contraction of the heat transfer medium as the wheel rotates through the hot and cold air ducts and the difference in temperature axially across the wheel also causes some distortion in the stacked spiral strips and also in the outer rim. With the preferred arrangement, the support rods are spaced from the hot side of the wheel thereby allowing the strips on the hot side to expand and contract without adverse stressing. The triangular truss formed by the rods also tends to oppose and counteract the tendency for the entire stack to distort radially. Additionally, any expansion or contraction, or distortion, of the rim can take place without stressing since the rim adjacent the hot face of the wheel has freedom to move. This is particularly important in a high temperature application where air, or other gaseous process medium, may approach the wheel at very high temperatures and wherein there is a substantial difference in temperature of the air in the upstream and downstream portions of the hot air duct and in the temperature of the air in the hot air duct and the cold air duct.

Alternative arrangements of the invention are also possible, such as where in each axial plane both rods are disposed at an angle to the opposite surfaces of the heat wheel as well as each other. In the embodiment where one of the rods is parallel to a surface of the heat wheel, that rod can be disposed either in a drilled hole through the spiral wound heat media or in a groove cut in the surface of the heat wheel medium.

Various other features and advantages of the invention will be apparent by reference to the following description, claims and drawings.

BRIEF DESCRIPTION OF THE DRAWINGS

FIG. 3 is a cross sectional elevation view illustrating means for forming the heat wheel.

FIG. 6 is an enlarged cross section view of the heat wheel shown in FIG. 1.

FIG. 7 is a cross section view of the heat wheel shown in FIG. 6.

FIG. 8 is an alternative embodiment of the structure shown in FIG. 7.

FIG. 9 is a view similar to FIG. 6 and showing an alternative construction.

Figure 1:
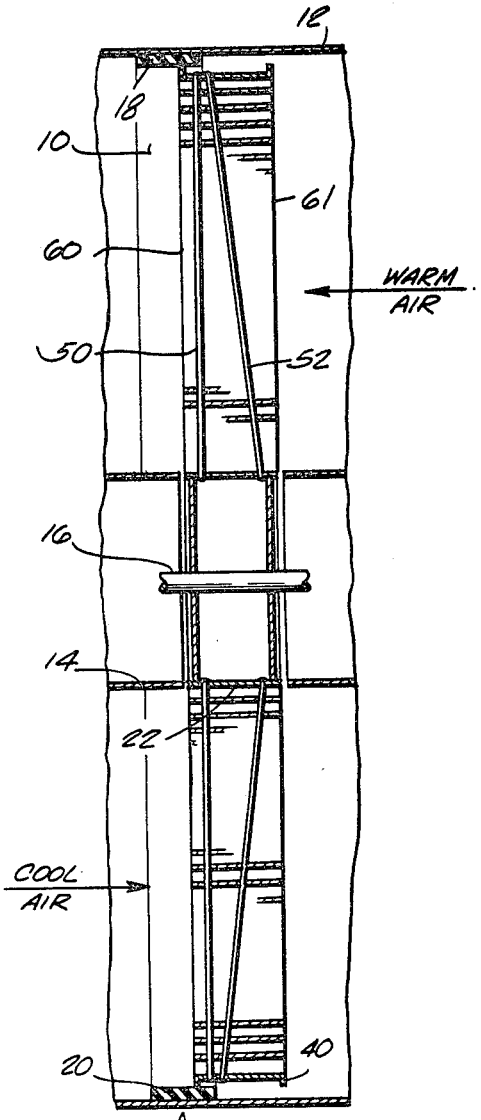
FIG. 1 is a cross section view illustrating a heat wheel embodying the present invention and illustrated as transferring heat from a hot air duct to a parallel cool air duct.

Before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

FIG. 1 illustrates a heat transfer wheel 10 embodying the present invention and employed to transfer heat from air flowing through a hot air duct 12 to air flowing through a cool air duct 14. The heat transfer wheel 10 is supported for rotation about an axis intermediate the air ducts 12 and 14, and a portion of the heat transfer wheel extends into one of the ducts while a second portion of the heat transfer wheel extends into the other duct. The heat transfer wheel 10 is constructed in a manner to be described in detail hereafter and generally includes a plurality of air passages parallel to its axis of rotation such that air in the hot air duct can readily flow through the heat transfer wheel thereby heating the wheel. Means are also provided (not shown) for causing rotation of the wheel about the shaft 16 such that the portion of the wheel heated in the hot air duct 12 is then rotated so as to move into the cool air duct 14 whereby the wheel 10 will heat the air in the cool air duct.

Means are also provided to form a seal between the periphery of the heat transfer wheel 10 and the interior of the ducts to insure that the air flowing through the ducts flows through the air passages of the heat transfer wheel. This means includes the seals 18 and 20.

Figure 4:
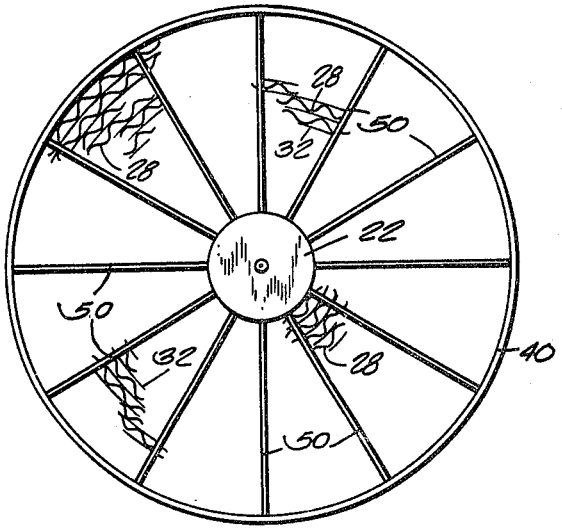
FIG. 4 is a plan view of the heat wheel illustrated in FIG. 3.
Figure 5:
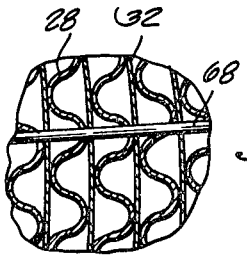
FIG. 5 is an enlarged partial view of the heat wheel shown in FIG. 4.
Figure 2:
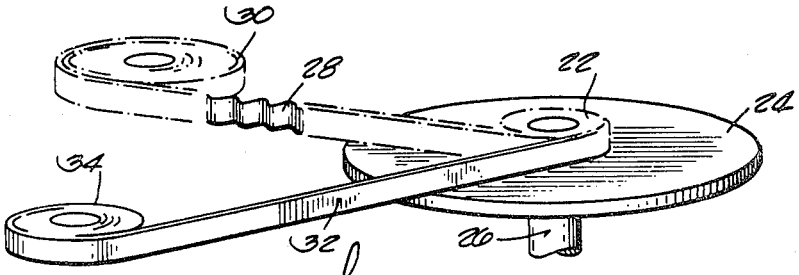
FIG. 2 is a schematic view illustrating the method of constructing the heat wheel embodying the invention.

A method of constructing the heat transfer wheel 10 shown in FIG. 1 is illustrated in FIGS. 2 and 3. A hub 22 is mounted on a rotatable circular table 24. The table is rotatably driven about the axis of a vertical shaft 26. A strip 28 of corrugated metal supported by a feed roll 30 and a strip 32 of flat metal supported by a feed roll 34 are wound around the hub 32 to form a continuous concentric spiral pattern around the hub as shown in FIG. 4, the corrugated and flat metal strips 28 and 32 being wound in an interleaved fashion and in such a manner that the parallel air passages are formed by the openings between the corrugated strip 28 and the adjacent flat strip 32. Heat transfer wheels of the type embodying the invention can be employed in sizes having diameters as large as 12 feet or more. Wheels of this diameter are constructed by continuing to rotate the table 24 supporting the hub 22 and continuing to wind the corrugated and flat metallic strips 28 and 32 around the hub 22 until a wheel of the desired size is achieved.

When the heat transfer wheel 10 of the desired size has been formed, a metal rim 40 is then placed around the wound strips and secured in place and secured to the metallic strips, the metal rim 40 functioning to tightly restrain the wound strips.

While the corrugated and flat metallic strips 28 and 32 can be comprised of various materials, in preferred embodiments of the invention either aluminum or steel can be employed.

One of the principal problems in the manufacture or construction of a heat transfer wheel 10 of the type described and employing a series of continuous spiral metal strips wound around a central hub 22 is that means must be further provided to prevent lateral shift of the concentric layers with respect to each other to prevent telescoping of the wheel. For example, when the heat transfer wheel is mounted as in FIG. 1, dynamic air pressure on the periphery of that portion of the heat transfer wheel 10 in the hot air duct 12 would tend to deflect it to the left when the air flow in duct 12 is in that direction. Similarly, dynamic pressure of air on that portion of the periphery of the heat transfer wheel in the cool air duct 14 would tend to deflect to the right when the air flow in the cool air duct is in the direction indicated. Additionally, in the case of heat transfer wheels which are relatively large, the mass of that portion of the wheel above the axis of rotation tends to compress the radially inner material of the wheel against the hub 22, and the mass in the lower portion of the wheel tends to cause the wheel material to pack against the wheel rim 40.

The wheel embodying the invention includes rigidifying means for preventing bending of the wheel as well as for preventing such shifting of the mass of the wheel as the wheel rotates. This rigidifying means comprises a number of pair of rods 50 and 52 extending from the wheel hub 22 to the rim 40 and interior of the mass of the wheel, the pairs of rods 50 and 52 being spaced angularly around the wheel and extending radially outwardly from the hub 22 to the rim 40 as spokes. In one form of the invention, as illustrated in FIG. 4, pairs of rods are spaced at 30° intervals around the wheel. Each pair of rods is shown more particularly in FIG. 6.

FIG. 3 illustrates the means for inserting the pairs of support rods 50 and 52 into the transfer wheel. The apparatus for forming the wheel includes a drill 54 having an elongated bit 56. During construction of the wheel, and after the rim 40 has been secured in place around the wrapped strips of corrugated and flat metal 28 and 30, a first bore 58 is drilled through the rim 40, through the layers of corrugated and flat metal, and through the hub 22, the first bore 58 extending radially inwardly and being positioned closely adjacent one planar face 60 of the transfer wheel and parallel to that face. The drill 54 is supported by a base structure 62 in turn supported for pivotal movement about a pivot axis 64 adjacent the peripheral edge of the table 24. The drill 54 can be pivoted upwardly about the pivot axis 64 to the position shown in phantom in FIG. 3 whereby the drill 54 can then drill a bore 68 radially inwardly and downwardly as shown in FIG. 3. The second bore 68 also extends through the rim 40, through the layers of metal strips, and through the hub 22. Similar pairs of bores 58 and 68 can be formed by indexing the table 24 with respect to the drill 54 so that a plurality of sets of bores can be formed in the wheel, for example at 30° increments around the wheel. Metal rods 50 and 52 are then driven into the elongated bores 58 and 60, respectively, and the radially inner ends of the rods 50 and 52 are welded to the hub 22 while the radially outer ends of the rods are welded to the rim 40.

When the heat transfer wheel 10 is formed in this manner, the radially outer ends of the rods are positioned in closely adjacent relation to each other at the rim 40 and the radially inner ends of the rods are in spaced apart relation in the direction of the longitudinal axis of the wheel. Accordingly, when the rods are viewed in radial planes including the longitudinal axis of the wheel, the rods 50 and 52 form two elongated sides of a triangular truss, the two elongated sides being joined by the hub 22. This construction can be seen to form a rigid triangular truss in the radial plane to thereby provide substantial structural support for the wheel 10 in such a manner that a force on the periphery of the wheel and in the direction of the longitudinal axis or the axis of rotation of the wheel will not result in substantial movement of the rim 40 with respect to the hub 22.

In a preferred form of the invention, the wheel 10 will be mounted such that the rods 50 disposed adjacent the planar face 60 of the wheel will be located on the downstream or cooler side of the hot air duct 12. In some uses of the invention, the air or gases in the hot air duct 12 may be at high temperatures on the upstream side of the heat transfer wheel 10. The heat transfer wheel 10 may cool the air in the hot air duct such that the air on the downstream side of the hot air duct 12 is substantially cooler than that on the upstream side of the heat transfer wheel and it will also heat the air flowing through the cold air duct 14. It will be appreciated that as the upstream side of the transfer wheel 10 moves from the cool air duct 14 to the hot air duct 12, the metal, particularly on the upstream face 61 will expand due to thermal expansion. The arrangement of the rods 50 and 52 facilitates such thermal expansion of that portion of the metal adjacent the upstream face 61 of the wheel as well as thermal contraction of that portion of the wheel upon movement of the wheel from the hot air duct 12 to the cooler air duct 14. Such thermal expansion is illustrated in exaggerated form in the dashed lines in FIG. 6.

Another advantage of the construction described is that the truss arrangement formed by rods 50 and 52 prevents radial movement of the layers of corrugated and flat metal bands. In the construction of large heat transfer wheels, the weight of the layers of the metal tends to compress that portion of the wheel which is above the hub 22 and to distend downwardly that portion of the heat transfer medium below the hub 22 and to compress that material against the rim 40. Since the rods 50 and 52 extend transversely across the thickness of the wheel 10 from one planar face 60 to the other 61, these rods prevent radial movement of the layers of corrugated and flat metal strips.

Another advantage of the construction described is that the wheel is strengthened without substantial obstruction of air flow through the wheel and in a manner that facilitates manufacture of the wheel at reduced cost.

FIG. 8 illustrates an alternative embodiment of the invention wherein the support rod 50 is housed in a radial groove 70 in the planar face 60 of the transfer wheel rather than in a bore 58. During construction of a transfer wheel arranged in this manner, a groove 70 can be milled in the upper surface 60 of the transfer wheel and the rod 50 can be laid into this groove.

FIG. 9 illustrates another alternative embodiment of the invention and wherein the support rods 50 and 52 are positioned such that their radially outer ends are closely adjacent and welded to the center of the rim 40, and such that they diverge outwardly as they extend from the rim 40 to the hub 22.

Various features of the invention are set forth in the following claims.

I claim:

1. A heat transfer wheel for use in a heat exchanger and for transferring heat from air flowing through a first air duct to air flowing through a second air duct, the wheel comprising:

a central hub adapted to rotate about an axis, a porous heat exchanger mass surrounding said hub, said mass including a number of air flow passages parallel to said axis, a rim around said mass to secure said mass in position, a first rod extending through said mass and having opposite ends, one of said ends being fixedly secured to said hub and the other of said ends being fixedly secured to said rim, a second rod extending through said mass and having opposite ends, one of said ends being fixedly secured to said hub and the other of said ends being fixedly secured to said rim, said first and second rods lying in a plane extending radially outwardly with respect to said axis and including said axis, and said rods being disposed at an angle with respect to each other.

2. The heat transfer wheel as set forth in claim 1 wherein said porous heat exchanger mass is comprised of concentric layers of metal strips wound continuously around said hub, said layers comprising alternating layers of a corrugated metal strip and an adjacent flat metal strip overlaid on said corrugated metal strip.

3. A heat transfer wheel as set forth in claim 1 wherein said porous heat exchanger mass is comprised of a continuous spiral wrapping of flat and corrugated strips of heat absorbing material, said strips being laid together in adjacent relation and said material having opposite generally planar circular faces flush with opposite edges of said rim.

4. A heat transfer wheel as set forth in claim 3 wherein said wheel includes a first bore extending through said heat exchanger mass, said bore extending radially with respect to said axis from said hub to said rim, said bore being adjacent and parallel to one of said generally planar faces, said first bore housing said first rod.

5. A heat transfer wheel as set forth in claim 4 wherein said wheel further includes a second bore extending through said heat exchanger mass, said bore having a radially outer end adjacent one face of said material and a radially inner end adjacent the other face of said material, said second bore housing said second rod.

6. A heat transfer wheel as set forth in claim 1 and further including a second pair of radially extending angularly spaced members extending between said hub and said rim.

7. A method of forming an air-to-air energy exchange wheel which comprises the steps of spiral wrapping flat and corrugated strips of heat absorbing material around a metal hub having a longitudinal axis to form a circular wheel structure having a desired diameter, the wheel structure having opposite planar faces securing a rim around the wheel structure, forming a first radially extending bore in said wheel structure, said bore extending from said rim to said hub, forming a second radially extending bore in said spiral wrapped material, said bore extending from said rim to said hub, said first and second bores lying in a plane extending radially from said axis and including said axis, and said bores generally defining an acute angle, forcing a first elongated member into said first radially extending bore, securing one end of said first elongated member to said hub and the other end of said elongated member to said rim, forcing a second elongated member into said second radially extending bore, securing one end of said elongated member to said rim and an opposite end of said elongated member to said hub.

* * * * *